United States Patent [19]

Toriuchi

[11] 4,374,919

[45] Feb. 22, 1983

[54] DIFFUSION TRANSFER COLOR PHOTOGRAPHIC ELEMENT WITH U.V. ABSORBING AGENT ADJACENT PROTECTIVE LAYER

[75] Inventor: Masaharu Toriuchi, Minami-ashigara, Japan

[73] Assignee: Fuji Photo Film Co., Ltd., Kanagawa, Japan

[21] Appl. No.: 307,999

[22] Filed: Oct. 2, 1981

[30] Foreign Application Priority Data

Oct. 2, 1980 [JP] Japan ..... 55-138101

[51] Int. Cl.[3] ..... G03C 1/40; G03C 5/54; G03C 1/84

[52] U.S. Cl. ..... 430/220; 430/212; 430/214; 430/215; 430/512

[58] Field of Search ..... 430/220, 215, 512, 497, 430/216, 212, 214

[56] References Cited

U.S. PATENT DOCUMENTS 4,148,648 4/1979 Pfingston ..... 430/220

OTHER PUBLICATIONS

"Photographic Processes and Products", *Research Disclosure,* No. 15162, 11/76.

Carroll et al., *Introduction to Photographic Theory,* John Wiley & Sons, New York, ©1980, pp. 8 & 9.

*Primary Examiner*—Richard L. Schilling

*Attorney, Agent, or Firm*—Sughrue, Mion, Zinn, Macpeak and Seas

[57] ABSTRACT

A diffusion transfer color photographic element wherein (1) a light-sensitive sheet comprising a support having superposed thereon at least one silver halide emulsion layer having associated therewith a color image providing compound and (2) a cover sheet comprising a support having thereon at least one neutralizing layer and at least one neutralization timing layer are arranged so that they can contact each other with their supports remote the area of contact and which is so designed that a processing composition may be spread in a uniform layer between the light-sensitive sheet (1) and the cover sheet (2), further wherein a protective layer which consists essentially of a hydrophilic colloid is provided as the topmost layer of the light-sensitive sheet (1) and there is provided an ultraviolet absorbant-containing layer for light-sensitive sheet (1) adjacent the protective layer. The element exhibits improved storage stability.

8 Claims, No Drawings

DIFFUSION TRANSFER COLOR PHOTOGRAPHIC ELEMENT WITH U.V. ABSORBING AGENT ADJACENT PROTECTIVE LAYER

FIELD OF THE INVENTION

This invention relates to a diffusion transfer color photographic element, more particularly, to the layer construction of a light-sensitive sheet used in color diffusion transfer processing.

BACKGROUND OF THE INVENTION

Diffusion transfer photographic elements are well known; they typically are in integral unit form and comprise a light-sensitive sheet comprising a support having thereon silver halide emulsion layers having associated therewith color image-providing compounds, a cover sheet comprising a support having thereon a neutralizing layer and a neutralization timing layer, and an alkaline processing composition; details of such photographic elements are given in, for example, Belgian Pat. Nos. 732,985 and 757,959, Japanese Patent Publication No. 33679/73, etc.

Other examples of such diffusion transfer color photographic elements use a light-sensitive sheet which has a layer containing an ultraviolet absorbing agent at a position remote the support thereof (topmost layer); such are described in, for example, *Research Disclosure,* No. 152, 15162 (November 1976), etc.

Also known in the art are cover sheets involving the use of a neutralizing layer comprising an acid polymer, e.g., a homopolymer of acrylic acid or copolymers of acrylic acid and acrylic acid esters and one or more neutralization timing layers containing, e.g., acetyl cellulose, styrene-maleic anhydride copolymers, a copolymer latex of vinylidene chloride, a methylacrylate and acrylic acid and a polymethylmethacrylate latex, which layers are provided in this sequence from the support. Various neutralizing layers are disclosed in U.S. Pat. Nos. 3,362,819, 3,765,885 and 3,819,371, French Pat. No. 2,290,699, etc., and various neutralization timing layers are disclosed in U.S. Pat. Nos. 3,455,686, 3,421,893, 3,785,815, 3,847,615 and 4,009,030, in Japanese Patent Application (OPI) No. 14415/77 (the term "OPI" as used herein refers to a "published unexamined Japanese patent application"), etc. In addition, latex based neutralization timing layers are described in Japanese Patent Applications (OPI) 70839/80, 138432/79, 138433/79 and 128335/79, in *Research Disclosures,* 18452 and 18564, etc.

Cover sheets in such elements serve various purposes. For example, such are not only used to provide a space over a light-sensitive sheet where an alkaline processing composition can be uniformly spread, but can also have the function of controlling pH, i.e., the pH of an alkaline processing composition, which is usually 13 or higher, can be reduced to 7 or below after a prescribed time has passed after spreading of the composition. To impart such a pH controlling function to a cover sheet, a neutralizing layer (which neutralizes alkali introduced from a processing composition) and a neutralizing timing layer (which controls the time for pH reduction) are provided in or on the cover sheet.

In diffusion transfer color photographic elements, a light-sensitive sheet and a cover sheet are superposed such that the coated layer of the light-sensitive sheet is in contact with the coated layer of the cover sheet, as disclosed in, e.g., Belgian Pat. No. 757,959 and Japanese Patent Applications (OPI) Nos. 153628/75 and 153629/75.

Such integrated photographic elements are, in general, used in pack form as described in *Research Disclosure,* No. 187, 18714 (Nov. 1979), and the resulting pack element is loaded in a camera. The pack has a spring on one side thereof, and, due to the force of the spring, the light-sensitive sheet and the cover sheet of the photographic element are kept in intimate contact, i.e., the topmost coated layer of the light-sensitive sheet and the topmost coated layer of the cover sheet are in firm, direct contact until a photograph has been taken, supports for each forming a "sandwich" therefor.

As earlier described, an ultraviolet absorbing agent-containing layer can be employed as the topmost layer of the light-sensitive sheet and a neutralization timing layer can be employed as the topmost layer of the cover sheet. However, when such sheets are stored for a long period of time in intimate contact, oil-soluble additives contained in the light-sensitive sheet, e.g., an ultraviolet absorbing agent, a dispersing oil, a surface active agent, etc., can migrate into the neutralization timing layer of the cover sheet, and this phenomenon can markedly occur, especially at high temperature.

On the other hand, when an alkaline processing composition is spread over the surface of a neutralization timing layer, the timing layer must form a controlled permeability barrier to alkali to maintain the processing composition in a state of high alkalinity for a definite period of time, and after a desired time has elapsed it allows alkali to pass therethrough to reach the neutralizing layer laid therebeneath. In the neutralizing layer, the alkali contacted therewith is neutralized by acid polymer therein. Upon neutralization of the alkali by the acid polymer, silver development, chemical reaction of dye couplers with the oxidation products of developing agents and dye diffusion are halted. Thus, the neutralization timing layer functions to control the time elapsed before neutralization begins.

However, migration of oil-soluble compounds (such as an ultraviolet absorbing agent, an oil used as a dispersing aid, etc.) into the neutralization timing layer frequently alters the permeability of the neutralization timing layer to alkali (usually such lowers the permeability). It is thought that such a phenomenon results from plasticization of the neutralization timing layer, and this phenomenon is markedly observed in the case where the neutralization timing layer is present at the direct interior of a sandwich as earlier described and contains a polymer latex.

Reduction in neutralization timing time due to lowering the alkali-permeability of the neutralization timing layer results in a premature cessation of various steps necessary to produce an image, e.g., silver development, chemical reaction of dye forming compounds with oxidation products of developing agents, dye diffusion, etc., before the image formation has adequately proceeded. Consequently, high image density cannot be attained. It has been desired in the art to remove this problem.

Some approaches have been suggested to render compounds such as oils, ultraviolet absorbants, etc., resistant to diffusion into the neutralization timing layer. For instance, per one approach the molecular weight of such a compound is increased while in another approach the binder content of an ultraviolet absorbing layer is increased in order to render such a compound therein diffusion resistant. However, an increase in molecular weight of such a compound is attended by disadvantages such as the synthesis of an oil or an ultraviolet absorbant becomes difficult and the thickness of a layer containing such a compound increases. On the other hand, an increase in binder content causes an increase in thickness of the ultraviolet absorbing layer, whereby completion of image formation is delayed.

SUMMARY OF THE INVENTION

One object of this invention is to improve the long term storage stability of a diffusion transfer photographic element in integral unit form.

Another object of this invention is to provide an effective method for prevention of migration of substances which adversely influence image formation as a result of diffusion thereof from a light-sensitive sheet to a cover sheet in an integrated diffusion transfer photographic element.

A further object of this invention is to provide a method for effectively protecting the surface of a light-sensitive sheet on the coated layer side thereof against scratches, stickiness and adhesion to other parts of a photographic element and to thereby overcome various problems in the production and processing of such a photographic element.

The above-described objects are attained by the use of a diffusion transfer color photographic element wherein:

(1) a light-sensitive sheet comprising a support having superposed thereon at least one silver halide emulsion layer having associated therewith a color image-providing compound is used; and (2) a cover sheet comprising a support having thereon at least one neutralizing layer and at least one neutralization timing layer are arranged so that these sheets can contact each other on their sides opposite to their respective support sides, which element is also so designed that a processing composition may be spread in uniform layer form between the light-sensitive sheet and the cover sheet and which is characterized by the light-sensitive sheet additionally having a protective layer which consists essentially of a hydrophilic colloid at the position farthest from the support thereof and a layer containing an ultraviolet absorbant(s) adjacent the protecting layer is used.

DETAILED DESCRIPTION OF THE INVENTION

In one preferred embodiment, the light-sensitive sheet employed in this invention comprises a support having thereon, in sequence, a mordant-containing image-receiving layer, a light-reflecting white layer, a light shielding agent-containing light-shielding layer, at least one silver halide emulsion layer having associated therewith a color image-providing compound, an ultraviolet absorbing agent-containing layer and a protective layer. Where such a light-sensitive sheet is employed for obtaining color photographs, the silver halide emulsion layer having associated therewith a color image-providing compound includes a red-sensitive silver halide emulsion layer having associated therewith a cyan color image-providing compound, a green-sensitive silver halide emulsion layer having associated therewith a magenta color image-providing compound and a blue-sensitive silver halide emulsion layer having associated therewith a yellow color image-providing compound. Further, it is preferred to provide an interlayer containing an antistain agent (as illustrated by U.S. Pat. Nos. 2,336,327, 2,728,659, 2,360,290, 2,403,721, 3,701,197 and 3,700,453) or the like in the above-described light-sensitive sheet between the red-sensitive emulsion layer and the green-sensitive emulsion layer, or between the green-sensitive emulsion layer and the blue-sensitive emulsion layer.

In a more preferred embodiment, the light-sensitive sheet has a multilayer structure comprising the following layers 1 to 14;

1. support
2. image-receiving layer
3. white reflecting layer
4. light-shielding layer
5. cyan color image-providing compound-containing layer
6. red-sensitive emulsion layer
7. color mixing preventing agent-containing layer (interlayer)
8. magenta color image-providing compound-containing layer
9. green-sensitive emulsion layer
10. color mixing preventing agent-comprising layer (interlayer)
11. yellow color image-providing compound-containing layer
12. blue-sensitive emulsion layer
13. ultraviolet absorbing agent-containing layer
14. protective layer In the above-described multilayer structure, each of the three emulsion layers, that is, the red-sensitive, the green-sensitive and the blue-sensitive layers, can be split into two or more layers. In addition, the light-shielding layer and the cyan color image-providing compound-containing layer can be replaced by one layer comprising both a light-shielding agent and a cyan color image-providing compound.

As the support, a transparent support is preferred because the image can be observed from the support side.

The cover sheet employed per this invention, as described above, may have a construction wherein a neutralizing layer and a neutralization timing layer are provided on a support (preferably a transparent support).

A preferred cover sheet employed in this invention comprises a support having thereon, in sequence, a neutralizing layer and a neutralization timing layer. The neutralizing layer and the neutralization timing layer may each be made up of two or more layers. However, the cover sheet must not have a hydrophilic colloid layer on the neutralization timing layer positioned farthest from the support.

As an acid polymer(s) constituting the neutralizing layer, any known acid polymers as described above can be employed. Known substances as described above can also be employed in the neutralization timing layer.

This invention exhibits remarkable effects in the situation where the neutralization timing layer contains at least one polymer latex.

As hydrophilic colloids which can be employed in the protective layer of this invention, gelatin is particularly useful.

The term "gelatin" includes not only lime-processed gelatin but also acid-processed gelatin and enzyme-processed gelatin as described in, e.g., *Bull. Soc. Sci. Phot. Japan,* No. 16, p. 30 (1966). Gelatin derivatives obtained by the reaction of such gelatins with compounds such as acid halides, acid anhydrides, isocyanates, bromoacetic acid, alkane sultones, vinyl sulfonamides, maleinimide compounds, polyalkylene oxides, epoxy compounds, etc., can be also employed as hydrophilic colloids herein. Specific examples of such gelatin derivatives are described in U.S. Pat. Nos. 2,614,928, 3,132,945, 3,186,846 and 3,312,553, British Pat. Nos. 861,414, 1,033,189 and 1,005,784, Japanese Patent Publication No. 26845/67, etc.

As examples of useful hydrophilic colloids other than gelatin which can be employed for the protective layer, mention may be made of proteins such as graft polymers of gelatin with other high polymers, albumin, casein and the like; cellulose derivatives such as hydroxyethyl cellulose, carboxymethyl cellulose, cellulose sulfuric acid esters and the like; sugar derivatives such as sodium alginate, starch derivatives and the like; and various kinds of synthetic hydrophilic macromolecular substances such as homo- or copolymers of polyvinyl alcohol, the partial acetal of polyvinyl alcohol, poly-N-vinylpyrrolidone, polyacrylic acid, polymethacrylic acid, polyacrylamide, polyvinyl imidazole, polyvinyl pyrazole and the like.

As gelatin graft polymers, those which obtained by grafting homo- or copolymers of vinyl series monomers, such as acrylic acid, methacrylic acid, esters thereof, derivatives of these acids (e.g., amides), acrylonitrile, styrene, and the like, on gelatins can be employed. Particularly preferred graft polymers are those which are prepared by grafting onto gelatin polymers compatible with gelatin to a certain degree, e.g., polymers of acrylic acid, methacrylic acid, acrylamide, methacrylamide, hydroxyalkylmethacrylate and the like. Specific examples of useful graft polymers are described in, for example, U.S. Pat. Nos. 2,763,625, 2,831,767 and 2,956,884, and the like.

Representative synthetic hydrophilic macromolecular substances which may be employed for the protective layer in this invention are those which are described in German Patent Application (OLS) No. 2,312,708, U.S. Pat. Nos. 3,620,751 and 3,879,205, and Japanese Patent Publication No. 7561/68.

The coating amount (dry weight) of hydrophilic colloid(s) in the protective layer of this invention generally ranges from 0.05 g/m$^2$ to 5 g/m$^2$, preferably from 0.05 g/m$^2$ to 0.5 g/m$^2$.

The protective layer of this invention, which contains a hydrophilic colloid as a main component in a proportion of about 80% by weight or more (i.e., about 80% by weight to 100% by weight), may optionally contain a surface active agent as coating aid, a hardening agent, a thickening agent, a matting agent and other additives. As the matting agent, those which are described in, for example, *Research Disclosure,* No. 15162, p. 84 are useful. However, the matting agent is not limited to those substances and any substances having a matting effect can also be employed.

The above-described protective composition is typically coated as a layer having dry thickness of preferably about 0.05 micron to about 5 microns, more particularly about 0.05 micron to about 2 microns.

Any conventional ultraviolet absorbing agent(s) can be employed as ultraviolet absorbing agent(s) used in this invention, and such include those described in, for example, Japanese Patent Applications (OPI) Nos. 56620/76, 49029/77, 97425/78 and 128333/78, Japanese Patent Publication No. 30492/73, Japanese Patent Applications (OPI) Nos. 87326/75 and 50245/80, U.S. Pat. Nos. 3,215,530, 3,785,827, 2,719,162, 2,784,087 and 2,882,150, Japanese Patent Publication No. 11155/74, and the like. These ultraviolet absorbing agents may be used alone or as a mixture.

Ultraviolet absorbing agents preferably employed in this invention are benzotriazole compounds disclosed in U.S. Pat. No. 3,533,794, Japanese Patent Applications (OPI) Nos. 15149/75 and 50245/80, Japanese Patent Publication No. 26583/74, and the like; benzophenone compounds disclosed in Japanese Patent Application (OPI) No. 2784/71, Japanese Patent Publication No. 12586/80, U.S. Pat. No. 3,215,530, and the like; cinnamic acid ester compounds disclosed in U.S. Pat. Nos. 3,705,805, 3,707,375 and 4,200,464, and the like; and compounds having a butadiene skeleton in their molecular structure, as disclosed in U.S. Pat. Nos. 4,045,229 and 4,195,999, Japanese Patent Applications (OPI) Nos. 56620/76 and 128333/78, and the like. Of these compounds, cinnamic acid ester compounds and butadiene compounds are particularly preferred.

The ultraviolet absorbing agents preferably employed in this invention have a molecular absorbancy index of 5,000 or more in the maximum absorption wavelength range of 300 nm to 390 nm and are insoluble in water in the pH range of 3 to 8.

The above-described ultraviolet absorbing agents can be incorporated into a light-sensitive sheet using conventional techniques. In general, the ultraviolet absorbing agent is firstly dissolved in a solvent and then dispersed into a hydrophilic colloid (binder). Typical examples of such a solvent include tri-o-cresylphosphate, di-n-butylphthalate, diethyl laurylamide, 2,4-diamylphenol, etc. However, the solvent is not limited to these. For instance, an ultraviolet absorbing agent may be used in the form of a solution dissolved in a water-miscible organic solvent such as tetrahydrofuran, methyl alcohol, ethyl alcohol, isopropyl alcohol, acetone, ethyl acetate, 2-butanone, N-methylpyrrolidone, dimethylformamide, dimethyl sulfoxide and mixtures thereof. The resulting mixture is optionally added to a compatible polymer latex, e.g., of the kind described in German Patent Application (OLS) No. 2,541,274 and then is applied to a light-sensitive sheet.

Further, the ultraviolet absorbing agent can also be applied to a light-sensitive sheet using the method described in *Research Disclosure,* No. 15930.

The method of this invention is particularly effective in the case where the ratio of ultraviolet absorbing agent to hydrophilic colloid(s) is 0.2 or above (by weight) and the amount of the hydrophilic colloid(s) is about 1 g/m$^2$ or less, but it is not intended to be construed as being limited to such.

The ultraviolet absorbing agent-containing layer typically has a thickness of 2$\mu$ to 5$\mu$.

The silver halide emulsion used in the light-sensitive sheet of this invention is a hydrophilic colloidal dispersion of silver chloride, silver bromide, silver chlorobromide, silver iodobromide, silver chloroiodobromide or a mixture thereof. The halide composition is selected depending upon the end use of the light-sensitive material and the processing conditions. A silver bromide emulsion, a silver iodobromide emulsion and a silver chloroiodobromide emulsion containing not more than 10 mol% iodide, not more than 30 mol% chloride, balance bromide, are particularly advantageous.

Both silver halide emulsions of the kind which form a latent image at the surface of the grains to an appreciable extent (i.e., surface latent image type silver halide emulsion) and silver halide emulsions of the kind which form a latent image inside the grains and substantially no latent image on the surface of the grains (i.e., internal latent image type silver halide emulsion) can be used in this invention. However, the latter is particularly preferred. As examples of internal latent image type silver halide emulsions which are employed to advantage, mention may be made of conversion type emulsions, core/shell type emulsions, foreign metal incorporated emulsions and the like as described in U.S. Pat. Nos. 2,592,250, 3,206,313, 3,447,927, 3,761,276 and 3,935,014, etc.

Emulsions of this kind are suitable for obtaining direct positive images by development processing in the presence of nucleating agents after exposure. Typical examples of useful nucleating agents and processing conditions include: hydrazines as described in U.S. Pat. Nos. 2,588,982 and 2,563,785; hydrazides and hydrazones as described in U.S. Pat. No. 3,327,552; quaternary salt compounds as described in British Pat. No. 1,283,835, Japanese Patent Publication No. 38164/74, and U.S. Pat. Nos. 3,734,738, 3,719,494 and 3,615,615; sensitizing dyes having nucleating substituents in their dye molecules as described in U.S. Pat. No. 3,718,470; and acylhydrazinophenylthiourea series compounds as described in U.S. Pat. Nos. 4,030,925 and 4,031,127.

The silver halide emulsion(s) used in this invention can be provided with, if desired, color sensitivity over a wide wavelength range by the use of spectral sensitizing dyes. As spectral sensitizing dyes, cyanine dyes, merocyanine dyes and the like can be employed.

Various compounds can be utilized as color image-providing compounds to be employed in this invention, and in particular dye releasing redox compounds and dye developers are useful therefor.

As examples of useful dye releasing redox compounds which release dyes by hydrolysis under alkaline conditions upon oxidation by a redox reaction, mention may be made of those which are described in the following literature: U.s. Pat. Nos. 4,053,312, 4,055,428, 4,076,529, 4,152,153 and 4,135,929, Japanese Patent Applications (OPI) Nos. 149328/78, 104343/76, 46730/78, 130122/79, 3819/78, 12642/81, 16130/81 and 16131/81, etc.

Specifically, useful yellow dye releasing redox compounds are disclosed in U.S. Pat. No. 4,013,633, Japanese Patent Applications (OPI) No. 149328/78, 114930/76 and 71072/81, *Research Disclosure,* No. 17630 (1978) and No. 16475 (1977), etc.

Useful magenta dye releasing redox compounds are disclosed in U.S. Pat. Nos. 3,954,476, 3,931,144 and 3,932,308, Japanese Patent Applications (OPI) Nos. 23628/78, 106727/77, 65034/79, 161332/79, 4028/80, 36804/80, 73057/81, 71060/81 and 134850/81, German Patent Application (OLS) No. 2,847,371, etc.

Useful cyan dye releasing redox compounds are disclosed in U.S. Pat. Nos. 3,942,987, 3,929,760 and 4,013,635, Japanese Patent Applications (OPI) Nos. 109928/76, 149328/78, 8827/77, 143323/78, 47823/78 and 71061/81, etc.

In addition, as examples of dye releasing redox compounds of the kind which release dyes upon ring closure in moieties thereof not oxidized upon redox reactions, mention may be made of those which are described in, for example, U.S. Pat. Nos. 4,139,379, 3,980,479 and 3,908,479, German Patent Applications (OLS) Nos. 2,402,900 and 2,448,811, British Pat. Nos. 1,464,104 and 1,464,105, Belgian Pat. No. 864,656, etc.

Dye developers employable in this invention include those which are described in various patents, such as U.S. Pat. No. 2,983,606, etc., and those described in S. M. Bloom, M. Green, M. Idelson & M. S. Simon, *The Chemistry of Synthetic Dyes,* Vol. 8, compiled by K. Venkataraman, pp. 331–387, Academic Press, New York (1978), etc.

In the development processing of this invention, any silver halide developing agent which can cross-oxidize the color image-providing compound(s) can be used. These developing agents may be incorporated in an alkaline processing composition(s) or may be incorporated in appropriate photographic layers of the light-sensitive element (for example, a mordant layer, a white reflecting layer, a silver halide emulsion layer and a color image-providing compound-containing layer). Examples of developing agents which can be used in this invention are described below.

Typical examples of useful silver halide developing agents include hydroquinone compounds such as hydroquinone, 2,5-dichlorohydroquinone, 2-chlorohydroquinone, etc.; aminophenol compounds such as 4-aminophenol, N-methylaminophenol, 3-methyl-4-aminophenol, 3,5-dibromoaminophenol, etc.; catechol compounds such as catechol, 4-cyclohexylcatechol, 3-methoxycatechol, 4-(N-octadecylamino)catechol, etc.; phenylenediamine compounds such as N,N-diethyl-p-phenylenediamine, 3-methyl-N,N-diethyl-p-phenylenediamine, 3-methoxy-N-ethyl-N-ethoxy-p-phenylenediamine, etc.; 3-pyrazolidone compounds such as 1-phenyl-3-pyrazolidone, 1-phenyl-4,4-dimethyl-3-pyrazolidone, 4-hydroxymethyl-4-methyl-1-phenyl-3-pyrazolidone, 4-hydroxymethyl-4-methyl-1-p-tolyl-3-pyrazolidone, 1-m-tolyl-3-pyrazolidone, 1-p-tolyl-3-pyrazolidone, 1-phenyl-4-methyl-3-pyrazolidone, 1-phenyl-5-methyl-3-pyrazolidone, 1-phenyl-4,4-bis(hydroxymethyl)-3-pyrazolidone, 1,4-dimethyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(3-chlorophenyl)-3-pyrazolidone, 1-(4-chlorophenyl)-3-pyrazolidone, 1-(4-tolyl)-4-methyl-3-pyrazolidone, 1-(2-tolyl)-4-methyl-3-pyrazolidone, 1-(4-tolyl)-3-pyrazolidone, 1-(3-tolyl)-3-pyrazolidone, 1-(3-tolyl)-4,4-dimethyl-3-pyrazolidone, 1-(2-trifluoroethyl)-4,4-dimethyl-3-pyrazolidone, 5-methyl-3-pyrazolidone; etc.

Plural developing agents, as disclosed in U.S. Pat. No. 3,039,869, can be also employed. Such developing agents can be incorporated in a processing composition or a part or more of them can be incorporated in any one layer or several layers of a photographic element or a film unit. The above-described layers include, for example, silver halide emulsion layers, color image-providing compound-containing layers, interlayers and an image-receiving layer.

Processing compositions as used herein contain a base such as sodium hydroxide, potassium hydroxide, sodium carbonate or sodium phosphate, and have an alkalinity of pH 9 or higher, preferably pH 11.5 or higher. In addition, the processing composition(s) can contain an antioxidant such as sodium sulfite, an ascorbic acid salt or piperidinohexose reductone and/or a silver ion concentration controlling agent such as potassium bromide. Furthermore, the processing composition may contain a viscosity increasing compound such as hydroxyethyl cellulose or sodium carboxymethyl cellulose.

Moreover, the alkaline processing composition may contain a compound to accelerate development or dye diffusion (e.g., compounds such as benzyl alcohol and the like).

An insulating layer as described in Japanese Patent Application (OPI) 52056/80 may be provided between an interlayer and a color image-providing compound-containing layer. In addition, a silver halide emulsion may be incorporated in an interlayer, as described in Japanese Patent Application (OPI) 67850/81.

As the image-receiving layer, neutralizing layer, neutralization timing layer, processing composition and the like which can be used in the diffusion transfer color photographic element of this invention, those which are described in Japanese Patent Application (OPI) 64533/77 can be also applied in addition to their respective substances described hereinbefore.

A process for obtaining a diffusion transfer color image using the photographic element of this invention is described in *Photographic Science and Engineering,* Vol. 20, No. 4, pp. 155–164 (July/August, 1976) and similar publications.

Though the photographic element of this invention is preferably for color diffusion transfer use, the layer structure comprising a hydrophilic colloidal layer and an ultraviolet absorbing agent-containing layer adjacent thereto characteristic of this invention, can also be used in a diffusion transfer black-and-white photographic element.

The photographic element of this invention is usually used as an integral photographic film unit wherein the light-sensitive sheet need not be delaminated from the cover sheet after completion of processing, but it may be also used in a photographic unit of the type where delamination is carried out after the completion of the processing.

In accordance with one embodiment of this invention, the binder content in the ultraviolet absorbing agent-containing layer can be lowered by providing a protective layer adjacent thereto. When the total coated amount of binder(s) in the ultraviolet absorbing agent-containing layer and in the protective layer is adjusted so as to be the same as the coated amount of binder which is required for the ultraviolet absorbing agent-containing layer in the case that the protective layer is not provided thereon, the reduction in the neutralization timing time resulting from contact of such a light-sensitive sheet with an earlier described cover sheet is improved beyond anticipation. It is believed that this effect results from a remarkably high barrier effect against the migration of compounds from the ultraviolet absorbing layer due to an almost perfectly continuous layer made up substantially of hydrophilic colloid alone.

The object and effect of the protective layer of this invention are quite different from those of a hydrophilic colloidal layer provided as a topmost layer of a cover sheet as is described in Japanese Patent Application (OPI) 136823/78. Specifically, the first point of difference resides in the problem to be solved and the reasons for providing a hydrophilic colloidal layer as the hydrophilic colloidal layer of the cover sheet described in the above patent application is provided to prevent the generation of foam after processing and delamination of the cover sheet due to processing solution. The second point of difference resides in the coating facility (when the protective layer and the ultraviolet absorbant-containing layer are coated at the same time), and further in the adhesive force between the two layers involved, i.e., though the hydrophilic colloidal layer is at a position adjacent a neutralization timing layer in the cover sheet described in the above patent application, it is, in general, difficult to simultaneously coat a hydrophilic colloidal layer and a neutralization timing layer because they differ greatly in affinity to water; further, insufficient adhesion results between these two layers. In distinction, the protective layer of this invention does not have any disadvantages with respect to coating facility and adhesion force between the protective layer and the ultraviolet absorbant layer of this invention because the same hydrophilic binder can be employed in both layers.

The following examples are given to further illustrate this invention in greater detail.

EXAMPLE 1

Preparation of Light-Sensitive Sheets

Light-sensitive sheets 1 to 8 were prepared by coating on a transparent polyethylene terephthalate film support layers (a) to (g) described below in this order.

(a) Image receiving layer containing 3.0 g/m$^2$ of copoly[styrene-N-vinylbenzyl-N,N,N-trihexylammonium chloride](mole ratio of styrene to N-vinylbenzyl-N,N,N-trihexylammonium chloride: 3:7, molecular weight: about 10,000) and 3.0 g/m$^2$ of gelatin.

(b) White reflecting layer containing 20 g/m$^2$ of titanium dioxide (average particle size: about 0.1$\mu$) and 2.0 g/m$^2$ of gelatin.

(c) Light shielding layer containing 2.0 g/m$^2$ of carbon black (average particle size: about 0.1$\mu$) and 1.5 g/m$^2$ of gelatin.

(d) Layer containing 0.53 g/m$^2$ of a yellow dye releasing redox compound of the structural formula shown below, 0.13 g/m$^2$ of tricyclohexylphosphate and 0.7 g/m$^2$ of gelatin.

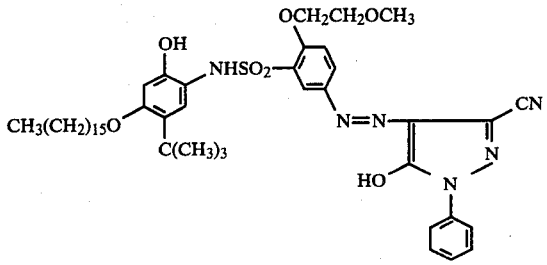

(e) Layer containing a blue-sensitive internal latent image type direct positive silver bromide emulsion containing 1.09 g/m$^2$ of silver), 1.1 g/m$^2$ of gelatin and 0.07 g/m$^2$ of the sodium salt of 2-sulfo-5-n-pentadecylhydroquinone.

(f) Layer containing 0.3 g/m$^2$ of an ultraviolet absorbing agent I of the structural formula below, 0.3 g/m$^2$ of a second ultraviolet absorbing agent II of the structural formula below and, further, gelatin in an amount as shown in Table 1.

(g) Layer containing gelatin in an amount as set forth in Table 1.

Ultraviolet Absorbing Agent I

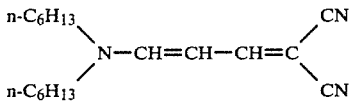

Ultraviolet Absorbing Agent II

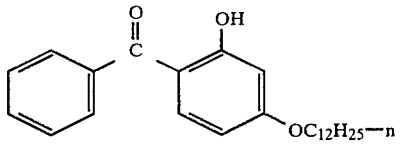

Light-sensitive sheet 8 was prepared for comparison and corresponded to a light-sensitive sheet having the layer structure above except that layer (f) was removed from the above-described layer construction.

Each of light-sensitive sheet Samples 1 to 8 thus prepared was superposed on a cover sheet (described hereinafter) in face-to-face contact therewith and the combination allowed to stand for 3 days at 50° C. and a relative humidity of 50% while a pressure of 1.5 kg per 100 $cm^2$ of contact area was applied thereto. Then, the neutralization timing time of each cover sheet was measured.

The neutralization timing time was determined in the following manner: each cover sheet to be examined was superposed on a sheet having a white pigment layer (20 $g/m^2$ of titanium dioxide as white pigment) in which Thymolphthalein ($1\times10^{-4}$ $mol/m^2$) had been dispersed as an acid-base indicator and an alkaline processing solution having the composition described hereinafter was spread thereover in a thickness of 100μ, whereafter the time required for the spectral density of the indicator to be reduced to one-half its initial value was measured. The results obtained are shown in Table 1 which show that an undesirable reduction in the neutralization timing time due to the described contact and heating can be markedly improved by providing layer (g), even when the total content of gelatin is not increased.

Construction of Cover Sheet

A cover sheet was prepared by coating on a transparent polyethylene terephthalate film support layers (1') to (3') described below in this order.

(1') A layer containing 22 $g/m^2$ of acrylic acid-butylacrylate copolymer (80:20 by weight, molecular weight: about 50,000) and 0.44 $g/m^2$ of 1,4-bis(2,3-epoxypropoxy)butane.

(2') A layer containing 3.8 $g/m^2$ of acetyl cellulose (a 100 g portion yielded 39.4 g of acetyl groups upon hydrolysis), 0.23 $g/m^2$ of the ring cleavage reaction product of a styrene-maleic anhydride copolymer (monomer fraction ratio: 60:40 by weight, molecular weight: about $5\times10^4$) with methanol, and 0.154 $g/m^2$ of 5-(2-cyano-1-methylthio)-1-phenyltetrazole.

(3') A layer having a thickness of 2 microns which was obtained by coating a mixture of a styrene-n-butylacrylateacrylic acid-N-methylolacrylamide copolymer latex (monomer fraction ratio: 49.7:42.3:4:4 by weight, average particle size: about 0.05μ) with methylmethacrylateacrylic acid-N-methylolacrylamide copolymer latex (monomer fraction ratio: 93:3:4 by weight, average particle size: about 0.05μ) in which a ratio of the dry weight of the former latex to that of the latter latex was controlled to 6:4.

Composition of Processing Solution

| | |
|---|---|
| 1-p-Tolyl-4-hydroxymethyl-4-methyl-3-pyrazolidone | 6.9 g |
| Methylhydroquinone | 0.3 g |
| 5-Methylbenzotriazole | 3.5 g |
| Sodium Sulfite (anhydrous) | 0.2 g |
| Sodium Salt of Carboxymethyl Cellulose (molecular weight: about 250,000) | 58 g |
| Potassium Hydroxide (28% aq. soln.) | 200 cc |
| Benzyl Alcohol | 1.5 cc |
| Carbon Black (average particle size: (about 0.1μ) | 150 g |
| Water | 685 cc |

TABLE 1

| | Sample | | | | | | | |
|---|---|---|---|---|---|---|---|---|
| | 1 | 2 | 3 | 4 | 5 | 6 | 7 | 8 |
| Gelatin Content ($g/m^2$) | | | | | | | | |
| Layer (f) | 0.3 | 0.45 | 0.6 | 1.0 | 0.2 | 0.3 | 0.6 | — |
| Layer (g) | — | — | — | — | 0.2 | 0.2 | 0.2 | 0.2 |
| Neutralization Timing Time (min.) | | | | | | | | |
| 15° C. | 8 | 10.5 | 11.5 | 12.5 | 14 | 14 | 14 | 14 |
| 25° C. | 3.0 | 3.3 | 3.6 | 3.9 | 4.3 | 4.3 | 4.3 | 4.3 |

EXAMPLE 2

Light-sensitive sheets were prepared by coating on a transparent polyethylene terephthalate film support the following layers in the order of description.

Light-Sensitive Sheet A (for comparison)

(1) Image-receiving layer containing 3.0 $g/m^2$ of copoly[styrene-N-vinylbenzyl-N,N,N-trihexylammonium chloride] (mole ratio of styrene to N-vinylbenzyl-N,N,N-trihexylammonium chloride: 3:7, molecular weight: about 10,000) and 3.0 $g/m^2$ of gelatin.

(2) White reflecting layer containing 20 $g/m^2$ of titanium dioxide (average particle size: about 0.1μ) and 2.0 $g/m^2$ of gelatin.

(3) Light-shielding layer containing 2.0 $g/m^2$ of carbon black (average particle size: about 0.1μ) and 1.5 $g/m^2$ of gelatin.

(4) Layer containing 0.44 $g/m^2$ of a cyan dye releasing redox compound of the structural formula below, 0.09 $g/m^2$ of tricyclohexylphosphate, 0.008 $g/m^2$ of 2,5-di-t-pentadecylhydroquinone and 0.8 $g/m^2$ of gelatin.

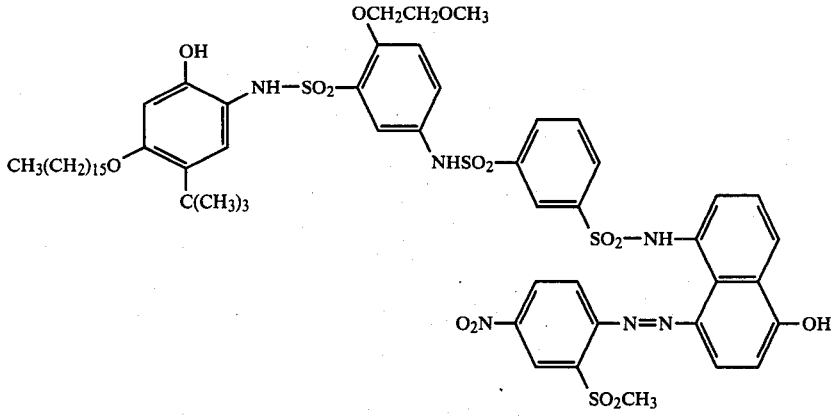

(5) Layer containing a red-sensitive internal latent image type direct positive silver bromide emulsion (containing 1.03 g/m$^2$ of silver), 1.2 g/m$^2$ of gelatin, 0.04 mg/m$^2$ of a nucleating agent of the following structural formula and 0.13 g/m$^2$ of the sodium salt of 2-sulfo-5-n-pentadecylhydroquinone.

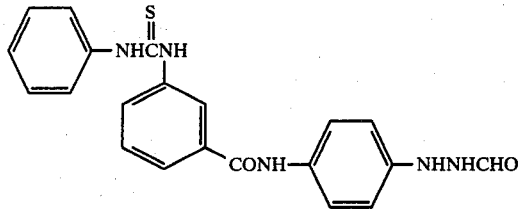

(6) Layer containing 0.43 g/m$^2$ of 2,5-di-t-pentadecylhydroquinone, 0.1 g/m$^2$ of trihexylphosphate and 0.4 g/m$^2$ of gelatin.

(7) Layer containing 0.21 g/m$^2$ of a magenta dye releasing redox compound of the following structural formula I, 0.11 g/m$^2$ of a magenta dye releasing redox compound of the following structural formula II, 0.08 g/m$^2$ of tricyclohexylphosphate, 0.009 g/m$^2$ of 2,5-di-t-pentadecylhydroquinone and 0.9 g/m$^2$ of gelatin.

Structural Formula I

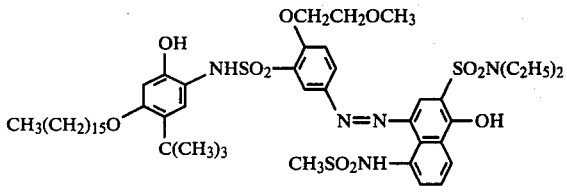

Structural Formula II

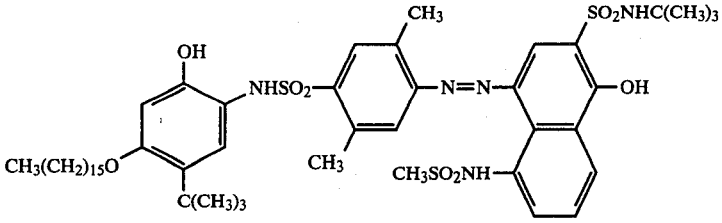

(8) Layer containing a green-sensitive internal latent image type direct positive silver bromide emulsion (containing 0.82 g/m$^2$ of silver), 0.9 g/m$^2$ of gelatin, 0.03 mg/m$^2$ of the same nucleating agent as in layer (5) and 0.08 g/m$^2$ of the sodium salt of 2-sulfo-5-n-pentadecylhydroquinone.

(9) The same layer as layer (6).

(10) Layer containing 0.53 g/m$^2$ of a yellow dye releasing redox compound of the following formula, 0.13 g/m$^2$ of tricyclohexylphosphate, 0.014 g/m$^2$ of 2,5-di-t-pentadecylhydroquinone and 0.7 g/m$^2$ of gelatin.

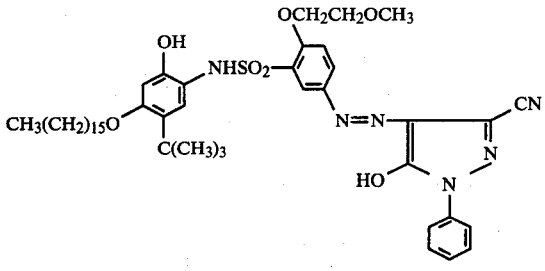

(11) Layer containing a blue-sensitive internal latent image type direct positive silver bromide emulsion (containing 1.09 g/m$^2$ of silver), 1.1 g/m$^2$ of gelatin, 0.04 mg/m$^2$ of the same nucleating agent in layer (5) and 0.07 g/m$^2$ of the sodium salt of 2-sulfo-5-n-pentadecylhydroquinone.

(12) Layer containing 0.6 g/m$^2$ of gelatin, 0.3 g/m$^2$ of the same ultraviolet absorbing agent I as used in Example 1, 0.3 g/m$^2$ of the same ultraviolet absorbing agent II as used in Example 1, 0.06 g/m$^2$ of tris(2-ethylhexyl)phosphate, 0.02 g/m$^2$ of polymethylmethacrylate latex (average particle size: about 4$\mu$) and 0.02 g/m$^2$ of triacryloyltriazine as a hardener.

Light-Sensitive Sheet B (this invention)

Layers (1) to (11) were provided in the same manner as in the light-sensitive sheet A and, further, the following layers (12) and (13) were provided on the layer (11) in this order.

(12) The same layer as layer (12) of light-sensitive sheet A, except that polymethylmethacrylate latex was not present therein and the gelatin content was changed from 0.6 g/m$^2$ to 0.3 g/m$^2$.

(13) Protective layer containing 0.2 g/m$^2$ of gelatin and 0.02 g/m$^2$ of polymethylmethacrylate latex (average particle size: about 4$\mu$).

Each of light-sensitive sheets A and B was contacted with a cover sheet as in Example 1 and heat was applied thereto under the same conditions as in Example 1. The resulting light-sensitive sheets each was exposed to light through a conventional photographic wedge, whereafter between the light-sensitive sheet and the cover sheet the same processing solution as was used in Example 1 was spread in a thickness of 100$\mu$ at a temperature of 15° C. to develop the same. In addition, samples of these photographic elements which did not receive the contact heating treatment described above were developed in the same manner. In each case, the reflection densities of the blue (B), green (G) and red (R) images were measured. The thus-determined B, G and R maximum reflection densities are shown in Table 2.

Light-sensitive sheet B of this invention showed only a slight change in the maximum densities upon storage pressed against the cover sheet while under high pressure/temperature conditions.

TABLE 2

| | Without Contact/Heating | | | After Contact/Heating | | |
|---|---|---|---|---|---|---|
| | B | G | R | B | G | R |
| Light-Sensitive Sheet A (Comparison) | 1.65 | 1.98 | 2.12 | 1.40 | 1.71 | 1.83 |
| Light-Sensitive Sheet B (This Invention) | 1.64 | 1.99 | 2.11 | 1.59 | 1.92 | 2.05 |

While the invention has been described in detail and with reference to specific embodiments thereof, it will be apparent to one skilled in the art that various changes and modifications can be made therein without departing from the spirit and scope thereof.

What is claimed is:

1. A diffusion transfer color photographic element comprising (1) a light-sensitive sheet comprising a support having superposed thereon at least one silver halide emulsion layer having associated therewith a color image-providing compound, (2) a cover sheet comprising a support having thereon in sequence at least one neutralizing layer and at least one neutralization timing layer where said light-sensitive sheets and said cover sheet are arranged so that they may contact with each other on the sides opposite to their respective support sides, (3) an aqueous alkaline processing composition to be spread in a uniform layer between said light-sensitive sheet and said cover sheet, wherein said light-sensitive sheet (1) further comprising a protective layer which consists essentially of a hydrophilic colloid at a position farthest from the support thereof and a layer comprising an organic ultraviolet absorbant at adjacent to said protective layer and closer to the support thereof than said protective layer, and a dye-image receiving layer.

2. The diffusion transfer color photographic element as in claim 1, wherein said light-sensitive sheet comprises a transparent support having superposed thereon, in sequence, an image-receiving layer, a white reflecting layer, a light-shielding layer, a red-sensitive emulsion layer having associated therewith a cyan color image-providing compound, a color mixing inhibitor-containing layer, a green-sensitive emulsion layer having associated therewith a magenta color image-providing compound, a color mixing inhibitor-containing layer and a blue-sensitive emulsion layer having associated therewith a yellow color image-providing compound.

3. The diffusion transfer color photographic element as in claim 1, wherein said neutralization timing layer contains at least one polymer latex.

4. The diffusion transfer color photographic element as in claim 1, wherein said ultraviolet absorbant has a molecular absorbancy index of 5,000 or more in the maximum absorption wavelength range of 300 nm to 390 nm and is oil soluble insoluble in water in the pH range of 3 to 8.

5. The diffusion transfer color photographic element as in claim 1, wherein the protective layer of the light-sensitive sheet consists essentially of gelatin.

6. The diffusion transfer color photographic element as in claim 1, wherein the layer comprising the ultraviolet absorbant further comprises a binder and wherein the ratio of the content of the ultraviolet absorbant to that of binder contained in the ultraviolet absorbant-containing layer is 0.2 or more by weight.

7. The diffusion transfer color photographic element as in claim 1, wherein said protective layer has a coated film dry thickness of 0.05 micron to 5 microns.

8. The diffusion transfer color photographic element as in claim 1, wherein said ultraviolet absorbant is oil soluble and insoluble in water.

* * * * *